US007464834B2

(12) United States Patent
Law et al.

(10) Patent No.: US 7,464,834 B2
(45) Date of Patent: Dec. 16, 2008

(54) DISPENSING CONTAINER FOR TWO FLOWABLE PRODUCTS

(75) Inventors: Brian R. Law, Leicester (GB); Richard A. Laveault, Ft. Wayne, IN (US)

(73) Assignee: Rieke Corporation, Auburn, IN (US)

( * ) Notice: Subject to any disclaimer, the term of this patent is extended or adjusted under 35 U.S.C. 154(b) by 549 days.

(21) Appl. No.: 11/362,939

(22) Filed: Feb. 27, 2006

(65) Prior Publication Data

US 2007/0199954 A1 Aug. 30, 2007

(51) Int. Cl.
*B67D 5/56* (2006.01)

(52) U.S. Cl. ..... 222/129

(58) Field of Classification Search ..... 222/129, 222/327, 485, 135, 137, 136, 94, 105, 546, 222/562, 563; 239/119, 311
See application file for complete search history.

(56) References Cited

U.S. PATENT DOCUMENTS

| | | | | | |
|---|---|---|---|---|---|
| 1,699,532 | A | * | 1/1929 | Hopkins | 222/94 |
| 3,217,931 | A | * | 11/1965 | Farrar et al. | 222/94 |
| 3,326,386 | A | * | 6/1967 | Goodloe | 211/14 |
| 3,450,254 | A | * | 6/1969 | Miles | 206/216 |
| 3,680,740 | A | | 8/1972 | Kinnavy | |
| 3,704,811 | A | * | 12/1972 | Harden, Jr. | 222/4 |
| 3,851,800 | A | | 12/1974 | Swain | |
| 3,985,299 | A | * | 10/1976 | Brenez | 239/119 |
| 4,022,351 | A | * | 5/1977 | Wright | 222/190 |
| 4,245,788 | A | * | 1/1981 | Wright | 239/327 |
| 4,678,103 | A | | 7/1987 | Dirksing | |
| 4,798,311 | A | | 1/1989 | Workum | |
| 4,993,595 | A | | 2/1991 | Bertram et al. | |
| 5,143,261 | A | | 9/1992 | Drobish | |
| 5,328,050 | A | | 7/1994 | Hyatt | |
| 5,934,515 | A | | 8/1999 | Bennett | |
| 5,944,175 | A | | 8/1999 | Albisetti | |
| 6,176,395 | B1 | | 1/2001 | Abbott et al. | |
| 6,321,947 | B2 | | 11/2001 | Gross | |
| 6,550,647 | B1 | | 4/2003 | Kunz | |
| 7,306,126 | B2 | * | 12/2007 | Brugner | 222/485 |
| 7,334,705 | B2 | * | 2/2008 | Yashima et al. | 222/129 |
| 2005/0051576 | A1 | | 3/2005 | Brugner | |

FOREIGN PATENT DOCUMENTS

| | | | |
|---|---|---|---|
| EP | 0 893 365 | A1 | 1/1999 |
| WO | WO 02/36065 | A1 | 5/2002 |

* cited by examiner

*Primary Examiner*—George Nguyen
*Assistant Examiner*—Michael Hagedorn
(74) *Attorney, Agent, or Firm*—Woodhard, Emhardt, Moriarty, McNett & Henry LLP

(57) ABSTRACT

A dispensing container for two flowable products for separately dispensing the two flowable products includes a first container receiving a first flowable product and including a first dispensing outlet and defining a hollow interior, a second container receiving a second flowable product and including a second dispensing outlet, the second container being positioned in the hollow interior. A fitment is assembled into the first dispensing outlet and connects to the second dispensing outlet. The fitment defines an inner outlet for dispensing the second flowable product and an outer outlet for dispensing the first flowable product. An adapter sleeve is assembled to the fitment. A hollow dispensing spout is inserted into the inner container, through the inner outlet, and defines an open outlet. A threaded closing cap is connected to the adapter sleeve and includes a plug portion for closing off the open outlet of the dispensing spout.

30 Claims, 10 Drawing Sheets

DISPENSING CONTAINER FOR TWO FLOWABLE PRODUCTS

BACKGROUND OF THE INVENTION

The present invention relates in general to dispensing containers that include a container body, a closure connected into an outlet of the container body, and a closing cap assembled to the closure. More specifically, the present invention relates to a dispensing container that is constructed and arranged to separately contain two flowable products and to separately dispensing those two flowable products, although concurrently, so that the two flowable products are allowed to mix only after being dispensed (i.e., co-dispensing). Structural features and relationships disclosed by various embodiments of the present invention enable the two flowable products to be co-dispensed in a particular ratio. Some of the needs for this type of proportionate dispensing are described in U.S. Pat. No. 4,678,103, issued Jul. 7, 1987 to Dirksing.

As stated in the '103 patent, many chemical systems require two or more components to be kept separate before they are mixed and used in order to achieve certain desired properties. Such systems include epoxy adhesives, detergent and bleach combinations, detergent and fabric softener combinations, beverages, and foodstuffs, to list some of the possibilities. In such systems, it is usually important for the relative proportions of the components to remain within certain limits to achieve optimal results. In the preferred embodiment, the two products are a clear coat material and a lacquer thinner. These two products need to be mixed in order to achieve the desired viscosity for use in a spray paint gun or equipment.

When different amounts of such multi-component systems are needed, it has been generally necessary to first weigh-measure or volume-measure the components separately and then mix them by hand. In addition to being time consuming and messy, such systems are impractical because weighing or measuring devices are typically not available at the place where such multi-component systems are to be applied. Few households, for example, have measuring devices that permit proper proportioning of components in small quantities, and estimating proportions by eye is not only difficult, but risks failure in achieving the proper proportions and the corresponding optimal characteristics of the chemical system.

Related benefits of the disclosed embodiment of the present invention include the ability to provide everything in a single package and the elimination of any particular skill level to be able to measure out the two products in the right ratio. From a marketing perspective, the two-product combination in a single package ensures that both products will be purchased from the same manufacturer. When one of the two products is a common composition and not proprietary, it could be obtained from other sources, but for this two-product, pre-packaged combination.

There have been many attempts to provide plural-chambered dispensing devices that co-dispense two or more flowable products. However, in trying to maintain a constant pouring or dispensing ratio between the poured products, most of these devices require complex and expensive features which make the devices difficult and impractical to manufacture. In addition, the particular structures of these devices usually do not provide the degree of metering accuracy necessary for certain co-dispensing applications.

The '103 patent elected to address this design challenge by first placing an inner container within an outer container for the two flowable products and then placing a third, empty container inside of the inner container. The intent was to try and use the empty container to affect the pouring characteristics of the inner container in the same way that the inner container would presumably affect the pouring characteristics of the outer container.

In addition to the obvious inefficiencies of fabricating and installing a third, empty container, its size causes an increase in the overall size of the inner container and/or a reduction of the volume of product contained therein. As the inner container increases in size, so as to handle the desired volume of product, the outer container must correspondingly increase in size.

The present invention approaches this challenge of precisely and reliably co-dispensing two flowable products by focusing on the design of the container closure and on the design of any cooperating venting structures. This approach is considered to be more controllable with more accurate co-dispensing. This approach also permits greater design versatility in that different closure characteristics can be used to influence the proportions of the two flowable products without needing to change the size or shape of the inner and outer containers, but a change to the containers can be made, if desired. In one embodiment of the present invention, merely changing the fitment in terms of the inner and outer dispensing outlets allows the dispensing ratio to be changed in that the product dispensing ratio is dependent on the cross sectional flow area of the two concentric flowable product dispensing outlets defined by the fitment. When the inner dispensing outlet receives an extendable spout, as in the preferred embodiment, the spout cross sectional flow area determines the flow rate of the product from the inner container.

As will be described herein and as illustrated in the accompanying drawings, the present invention, as disclosed and claimed, provides a novel and unobvious advance in the state of the art for dispensing containers.

BRIEF SUMMARY OF THE INVENTION

A dispensing container for two flowable products, according to one embodiment of the present invention, comprises a first container constructed and arranged for receiving a first flowable product, the first container including a first dispensing outlet and defining a hollow interior, a second container constructed and arranged for receiving a second flowable product, the second container including a second dispensing outlet and being positioned within the hollow interior, a fitment assembled into the first dispensing outlet and including a threaded connection for connecting to the second dispensing outlet, the fitment defining an interior outlet for dispensing the second flowable product and an outer outlet for dispensing the first flowable product, an adapter sleeve assembled to the fitment, a hollow dispensing spout inserted into the inner container and axially-extending through the inner outlet, the hollow dispensing spout defining an open outlet, and a threaded closing cap constructed and arranged to connect to the adapter sleeve, the threaded closing cap including a plug portion constructed and arranged for closing off the open outlet of the dispensing spout.

One object of the present invention is to provide an improved dispensing container for two flowable products.

Related objects and advantages of the present invention will be apparent from the following description.

DETAILED DESCRIPTION OF THE INVENTION

Figure 1:
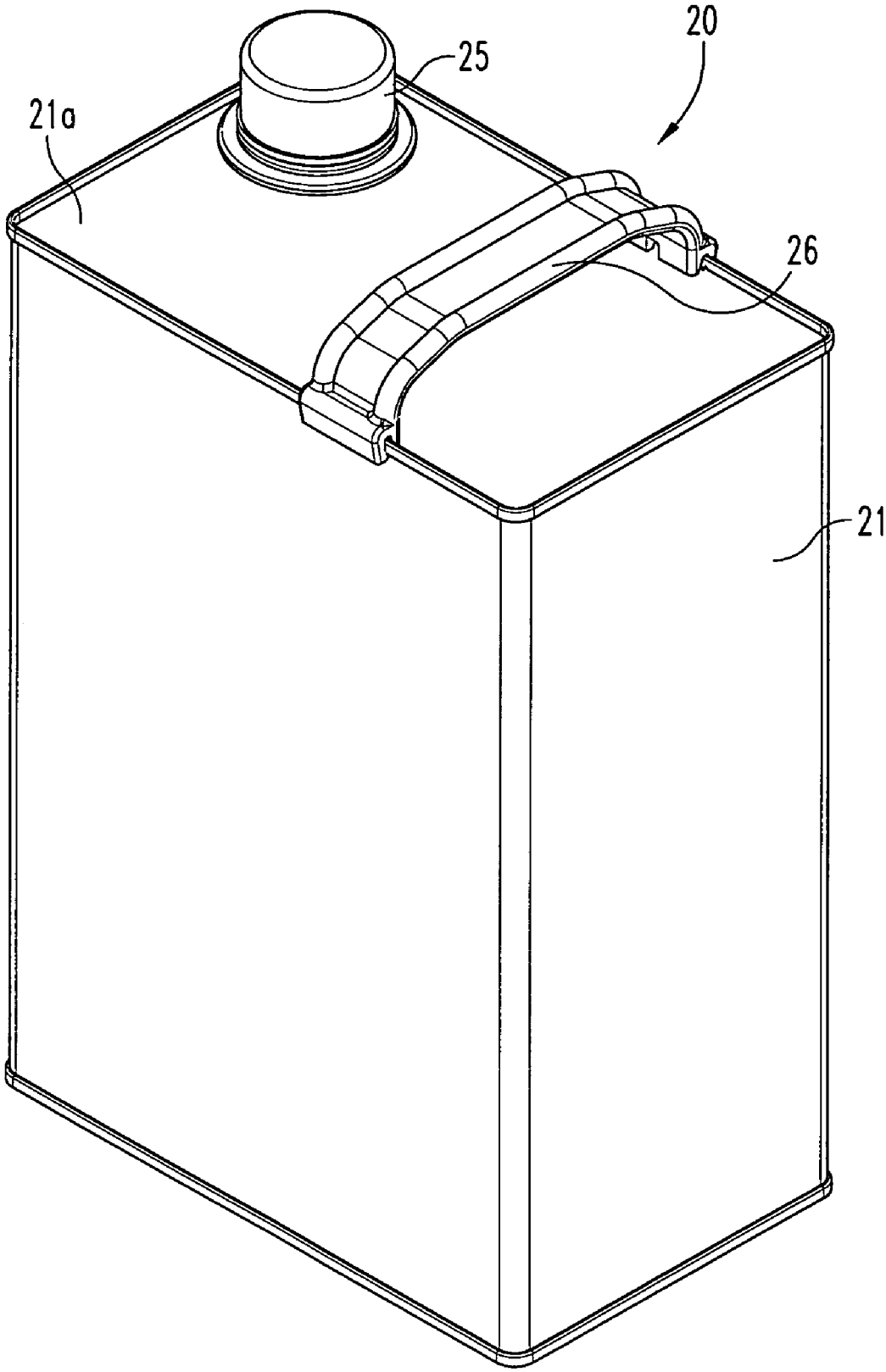
FIG. 1 is a perspective view of a dispensing container for two flowable products, according to a typical embodiment of the present invention.
Figure 2:
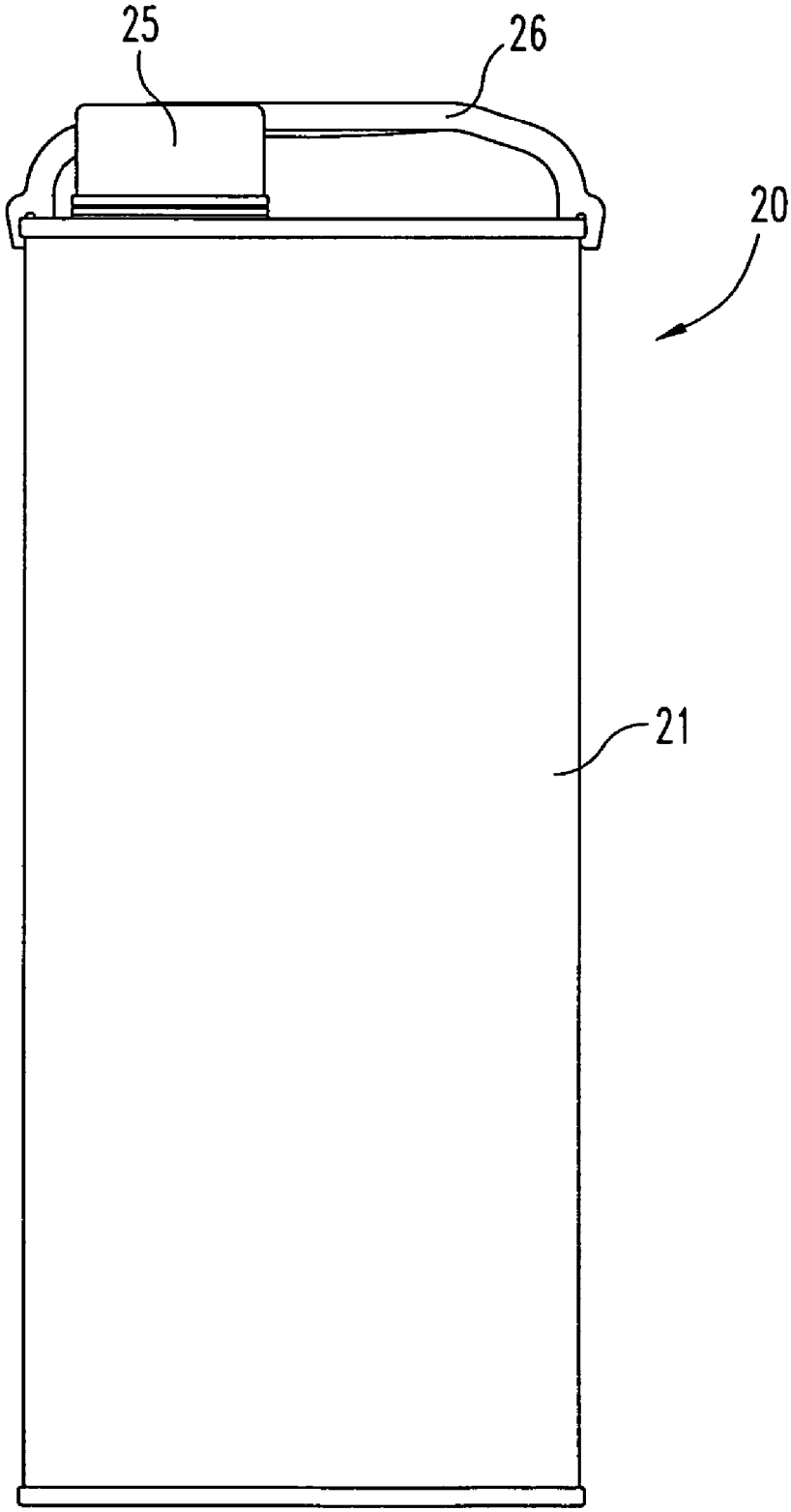
FIG. 2 is an end elevational view of the FIG. 1 dispensing container.
Figure 3:
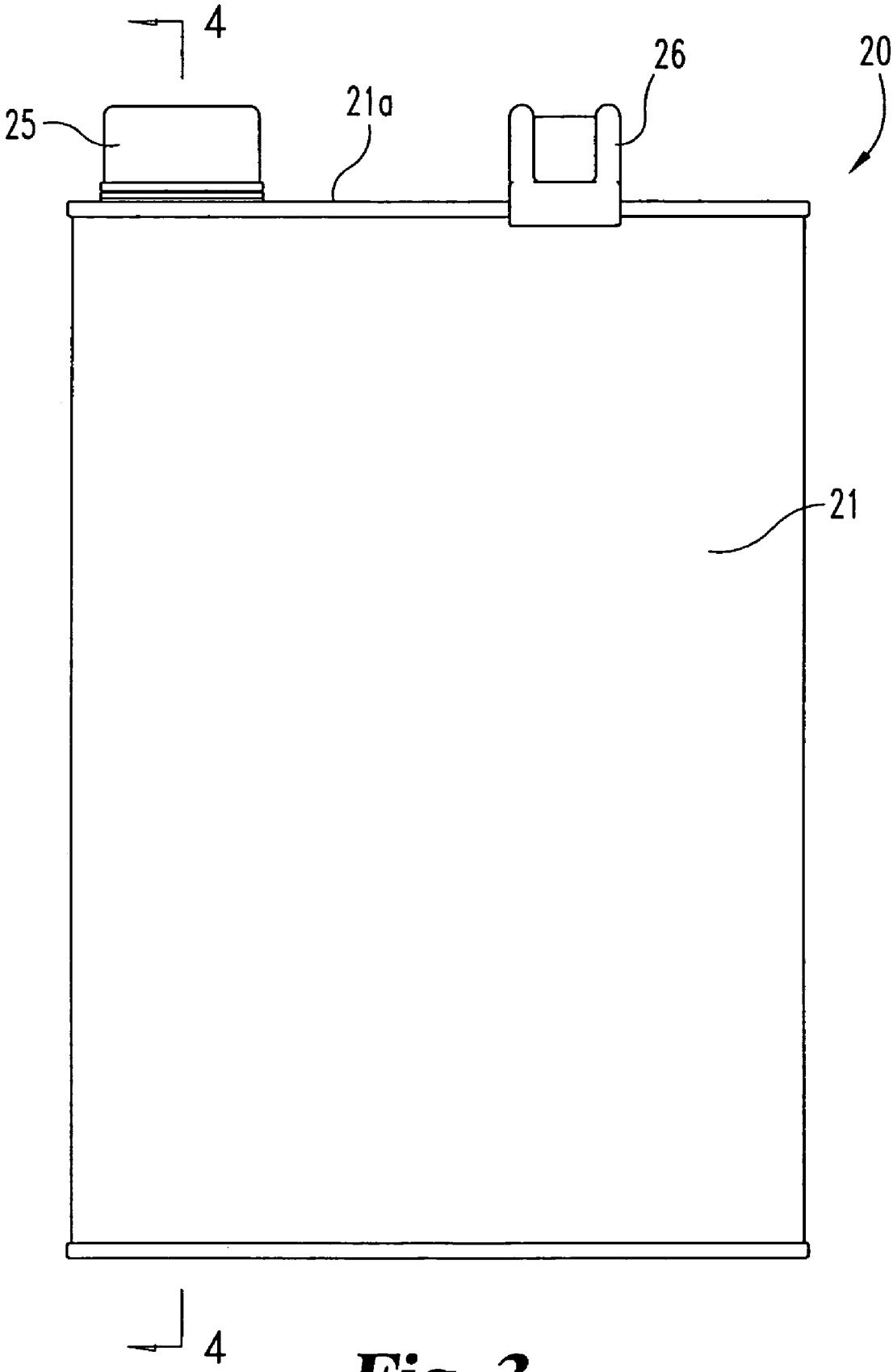
FIG. 3 is a front elevational view of the FIG. 1 dispensing container.
Figure 4:
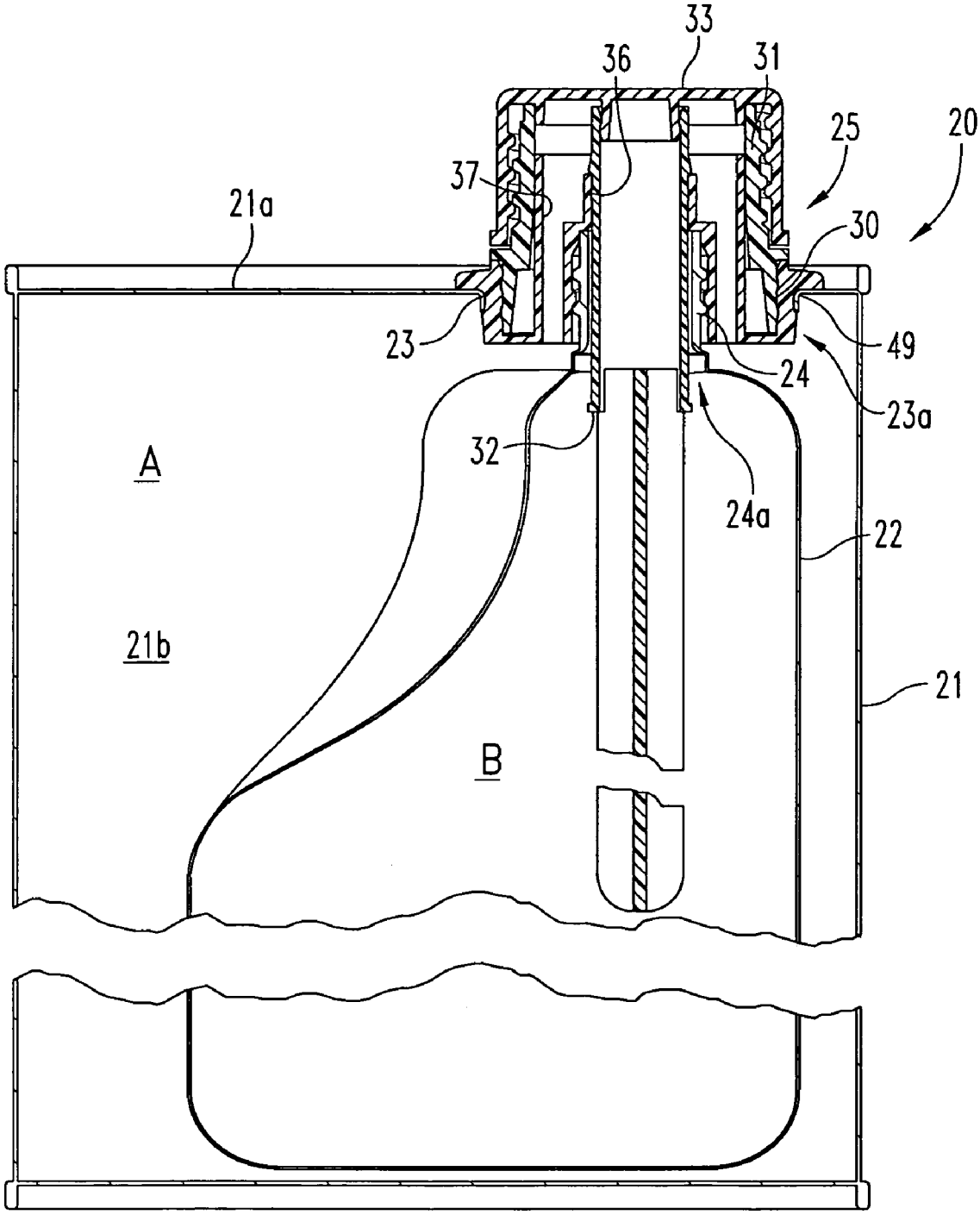
FIG. 4 is a partial, end elevational view, in full section, of the FIG. 1 dispensing container as viewed along line 4-4 in FIG. 3.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-6, there is illustrated a dispensing container for two flowable products A and B. Included as part of dispensing container 20 is an outer container 21 for product A and an inner container 22 for product B. While the size, shape, and material of containers 21 and 22 may vary, consistent with the teachings of the present invention, a metal can-type container with six generally rectangular sides or panels is preferred for outer container 21. To be more precise, container 21 includes four sidewalls, a closed base panel, and an upper panel 21*a* that defines an outlet 23 with an outlet opening 23*a*. A flexible, blow-molded container is selected to describe the preferred embodiment of inner container 22. However, a plastic bag or plastic pouch-type container having a collapsible body could be used equally as well for inner container 22. The ability of a plastic bag to collapse on itself as the product is dispensed means that the dispensing flow is smooth and continuous without glugging and without the need for a vent tube or a vent path. The use of a fully collapsible plastic bag or pouch also means that the bag material can be bunched and gathered to the point that it is sufficiently small to be inserted through outlet opening 23*a*, allowing the upper panel 21*a* to be seamed to the remainder of container 21 prior to installing container 22. When a blow-molded container 22 is selected or when any other rigid or semi-rigid container is selected for container 22, then assembly of container 22 into container 21 must be performed before upper panel 21 a is seamed to the sides of container 21. Also, venting needs to be considered if product glugging is going to be unacceptable.

Since a flexible, blow-molded container has been selected to describe the preferred embodiment of container 22, its installation into container 21 is performed before panel 21*a* is tightly seamed to the four sidewalls to complete container 21. While a vent structure is not included as a part of the preferred embodiment, a vent structure can be added to prevent glugging.

Figure 5:
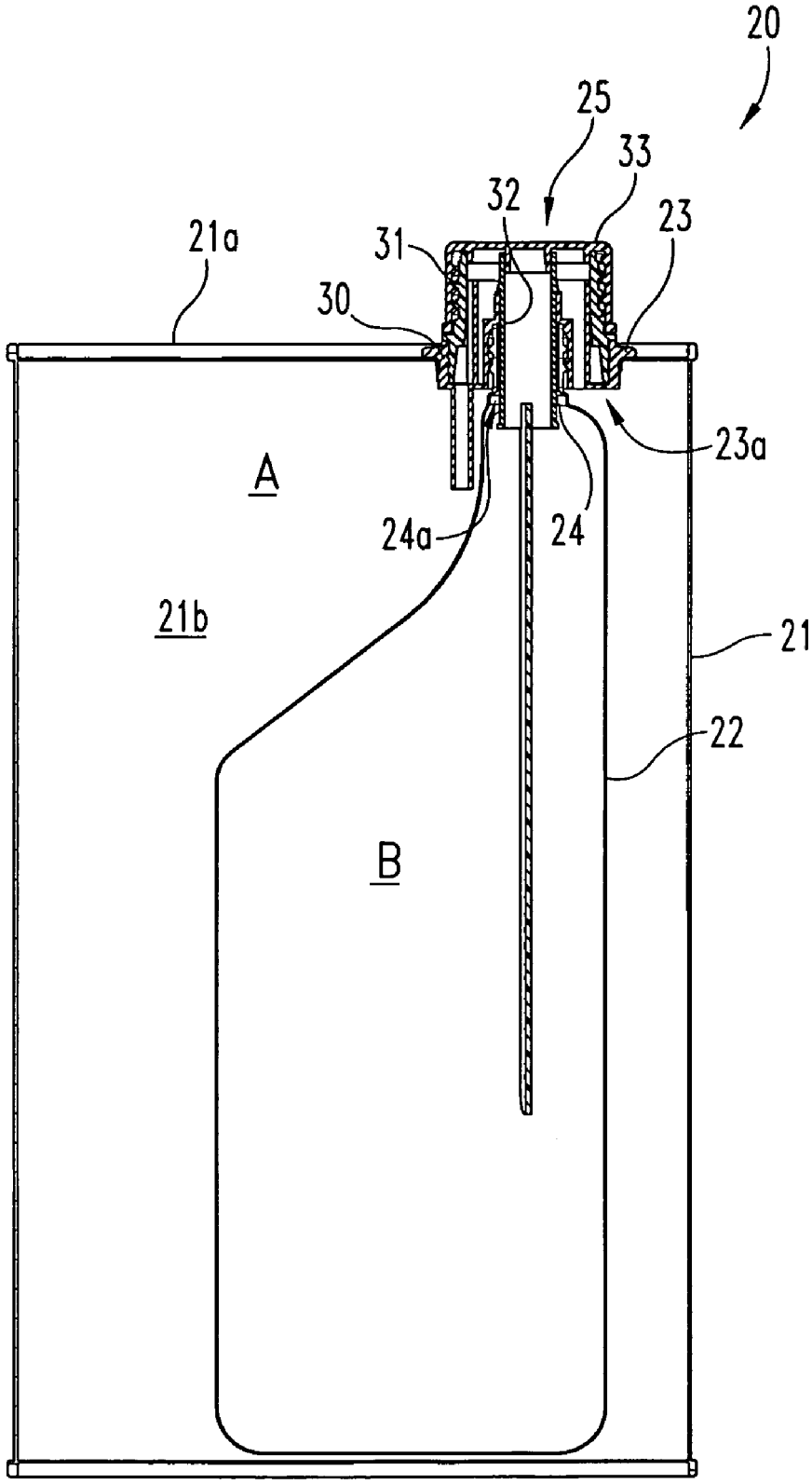
FIG. 5 is a partial, front elevational view, in full section, of the FIG. 1 dispensing container as viewed through a cutting plane that is turned 45 degrees from FIG. 4.
Figure 6:
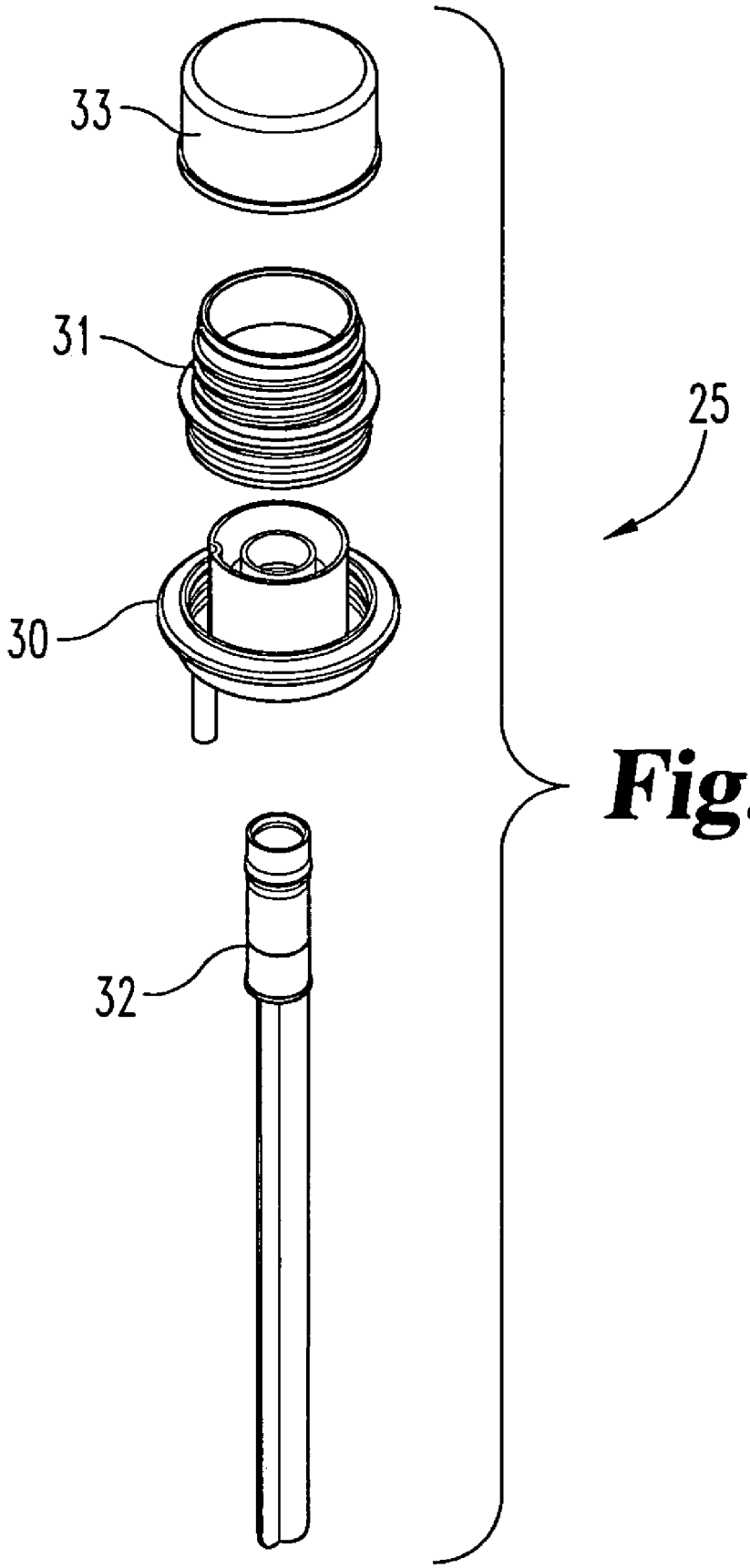
FIG. 6 is an exploded view of a closure assembly comprising a portion of the FIG. 1 dispensing container.

Container 22 defines an outlet 24 with an outlet opening 24*a*. In the preferred embodiment, outlet 24 involves an externally threaded neck that threadedly engages a portion of the closure that is used in combination with container 21 and 22 to create dispensing container 20. The positioning of container 22 within container 21 is such that opening 24*a* is aligned with opening 23*a* and, more specifically, these two openings are generally concentric with one another (see FIGS. 4 and 5). The container assembly identified herein as dispensing container 20 includes outer container 21, inner container 22, a snap-on handle 26, and is completed by closure assembly 25. Closure assembly 25 includes a snap-in closure fitment 30, an intermediate sleeve 31, a dispensing spout 32, and an outer threaded cap 33. The handle 26 is not shown in FIG. 4 due to the cutting plane. In FIG. 5, the handle 26 was removed simply for drawing clarity.

As noted, if a collapsible plastic bag or collapsible plastic pouch is used for container 22, it is anticipated that its size (mass) can be collapsed onto itself to reduce its size so that it can be inserted through outlet 23 into the hollow interior 21*b* of container 21. This means that container 21 can be completely fabricated prior to insertion of container 22. The fitment 30 includes an inner fitment outlet 36 and an outer fitment outlet 37 that concentrically surrounds outlet 36. Outlet 36 defines a generally cylindrical opening. Outlet 37 defines an interior opening for flow from container 22. The inner fitment outlet 36 connects to the outlet 24 of inner container 22 for the dispensing of product B from container 22. In the preferred embodiment of the present invention, the inner fitment outlet 36 is internally threaded and outlet 24, which forms the extended neck of container 22, is externally threaded for the threaded assembly or engagement into fitment outlet 36. This threaded connection of outlets is made prior to insertion of inner container 22 into container 21. Even if a collapsible plastic bag or pouch is selected for container 22 in lieu of a more rigid container, it is still necessary to connect the opening or outlet of container 22 to the outlet of fitment 30 and this connection or assembly would preferably be performed prior to insertion of the container 22 into container 21. It will also be noted under this procedure that the fitment will effectively be concurrently snapped into outlet 23 as container 22 is being installed.

When a flexible, blow-molded construction is selected for container 22, such that it must be installed into container 21 before panel 21*a* is seamed into place, the inner container 22 can be threaded into the fitment outlet 36 after fitment 30 snaps into outlet 23. Then, this subassembly of panel 21*a*, fitment 30, and container 22 is assembled to and into what becomes container 21. This final assembly step involves tightly seaming panel 21*a* to the four sidewalls of container 21.

Figure 7:
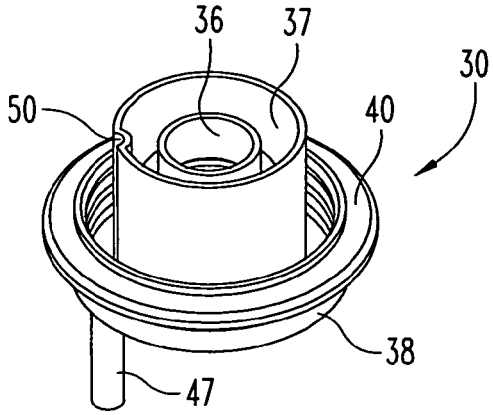
FIG. 7 is a perspective view of a fitment comprising one component part of the FIG. 6 closure assembly.
Figure 8:
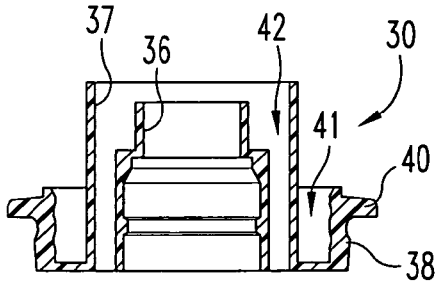
FIG. 8 is a side elevational view, in full section, of the FIG. 7 fitment based upon the FIG. 4 orientation.
Figure 9:
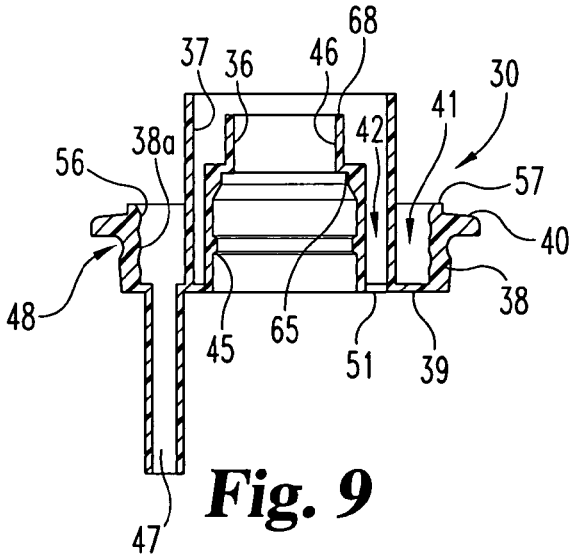
FIG. 9 is a front elevational view, in full section, of the FIG. 7 fitment based upon the FIG. 5 orientation.

Referring to FIGS. 7, 8, and 9, the details of fitment 30 are illustrated. Fitment 30 is a unitary, injection-molded component that is preferably fabricated out of polypropylene. Fitment 30 includes an outer annular wall 38, an annular base 39, an annular radial flange 40, and an annular clearance space 41 defined by and between wall 38 and outer fitment outlet 37. The concentric placement of fitment outlet 36 inside of fitment outlet 37 causes the dispensing flow path for product A from container 21 to have an annular ring cross sectional shape. The dispensing opening for product A is defined by the annular clearance space 42 between fitment outlet 36 and fitment outlet 37. The dispensing opening for product B is defined in part by inner fitment outlet 36. However, since inner fitment outlet 36 receives dispensing spout 32, it is actually dispensing spout 32 and its lateral cross sectional area that determines the flow outlet or flow area for product B. It is this cooperative combination of outlet 36 and dispensing spout 32 that creates the flow path for product B. Recognizing that the dispensing spout is effectively a line-to-line fit inside of outlet 36, it is the cross sectional area of spout 32 that defines the flow volume for product B. If spout 32 is not used, then the cross sectional area of outlet 36 controls the rate, volume, amount, and ratio of product B.

Fitment outlet 36 is shouldered with an internally-threaded larger portion 45 and a smaller, concentric sleeve portion 46. Portion 45 receives the externally-threaded outlet 24 of container 22 with threaded engagement. Portion 46 receives dispensing outlet 32 with a close, sliding fit. Included as part of base 39 is a vent tube 47 that extends away from base 39 into the hollow interior 21*b* of container 21. Fitment outlet 37 is defined by an annular wall that is constructed and arranged with a semi-cylindrical recess 50 that cooperates with vent tube 47 to provide a path into container 21 for venting air from the atmosphere. The outer annular wall 38 defines a recessed annular groove 48 adjacent the radial flange 40. Groove 48 receives the annular lip 49 of top panel 21*a* with a tight, snap-in interference fit (see FIG. 4). Annular lip 49 creates outlet 23 and defines outlet opening 23*a*. This tight, snap-in assembly of fitment 30 into outlet 23 results in a secure, leak-proof interface that prevents leakage of product A.

The concentric arrangement between the inner fitment outlet 36 and outer fitment outlet 37 is created and maintained by the use of three radially-extending, connecting webs 51. Webs 51 are equally-spaced apart from each other similar to three spokes radiating outwardly from a hub and these webs provide the only connection of the inner fitment outlet 36 to the remainder of fitment 30. The dispensing flow of product A out of container 21 flows past these three connecting webs and through the annular clearance space 42. The dispensing flow of product B out of container 22 flows through spout 32. In terms of the product A to product B mixing ratio, this is determined by the respective cross sectional flow areas of the two dispensing flows. The cross sectional area of annular clearance space 42 compared to the smaller cross sectional area of spout 32 determines the mixing ratio of product A to product B. Given the various dimensions that can be changed without a need to change either container, virtually any mixing ratio can be selected without needing to change, replace, or redesign either container 21 or container 22. For example, simply increasing the wall thickness of spout 32 without changing the outside diameter will reduce the flow of product B and increase the product A to product B ratio. In the preferred embodiment, these respective cross sectional areas are set for a 2:1 mix ratio of product A (container 21) to product B (container 22). However, virtually any ratio from 1:1 up to 5:1 is realistic for the disclosed construction. As the ratio approaches 1:1, the container volumes approach equality. As the ratio approaches 5:1, the inner container 22 gets proportionally smaller as the open volume of container 21 gets larger.

Assuming a desired 2:1 mixing ratio, hypothetical representative dimensions for outlets 36 and 37 and dispensing spout 32 could include an inside diameter of outlet 37 of one inch, a spout 32 wall thickness of 0.104 inches, and a spout inside diameter of 0.50 inches. This sample calculation ignores any effect in terms of a reduced cross sectional flow area due to webs 51 and extension member 61. Assuming these dimensions, the flow area of spout 32 is approximately 0.196 square inches. The annular ring flow area of outlet 37 is approximately 0.394 square inches, roughly twice the flow area of the spout.

Figure 10:
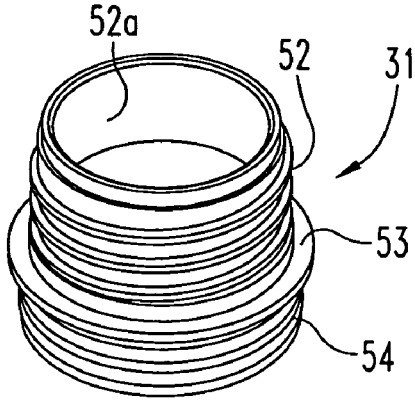
FIG. 10 is a perspective view of an adapter sleeve comprising one component part of the FIG. 6 closure assembly.
Figure 11:
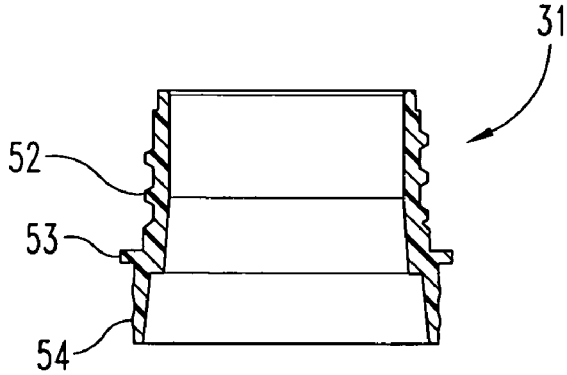
FIG. 11 is a side elevational view, in full section, of the FIG. 10 adapter sleeve based upon the FIG. 4 orientation.
Figure 12:
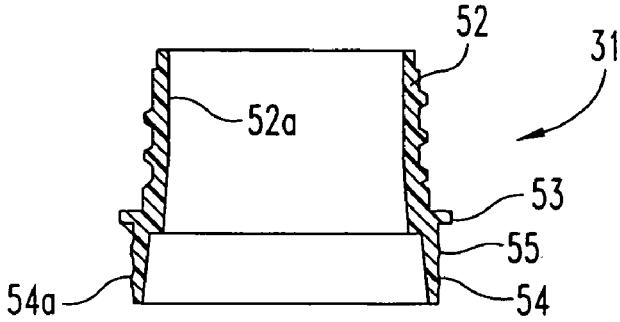
FIG. 12 is a front elevational view, in full section, of the FIG. 10 adapter sleeve based upon the FIG. 5 orientation.

Referring now to FIGS. 10, 11, and 12, the details of adapter sleeve 31 are illustrated. Adapter sleeve 31 is a unitary, injection molded component part that is preferably fabricated out of polypropylene. Adapter sleeve 31 has a geometry with three portions or sections including externally-threaded annular sidewall 52, radial flange 53, and lower annular wall 54. The external threads that are formed as part of sidewall 52 are constructed and arranged to receive the outer threaded cap 33. The inside surface 52*a* of sidewall 52 receives fitment outlet 37. The upper portion of sidewall 52 is substantially straight (i.e., cylindrical) while the lower portion, specifically the inside surface 52*a*, flares outwardly so as to create a conical shape. This flared, conical shape facilitates the sliding fit of adapter sleeve 31 down into fitment outlet 37 so as to establish a secure, tight, and leak-proof interface.

The outer surface 54*a* of annular wall 54 is formed with a series of corrugations or raised ribs 55 and the inside surface 38*a* of outer annular wall 38 is formed with a mutually engaging series of corrugations or raised ribs 56. Since the alternating raised and recessed portions of ribs 55 and 56 are relatively shallow, the adapter sleeve 31 is assembled into fitment 30 with a push-on, snap-in fit. The radial flange 53 abuts up against an upwardly extended, annular portion 57 of outer annular wall 38. The abutment of flange 53 against portion 57 limits the axial travel of adapter sleeve 31 into fitment 30.

It should be understood that adapter sleeve 31 is intended to be an extension of fitment 30 in terms of its overall design and function. The reason to separate these two components so as to separately injection mold fitment 30 and separately injection mold adapter sleeve 31 is simply for the ability to mold all of the required shapes and features. Considering the overall construction and geometry of these two components once they are snapped into a secure subassembly, it would be appreciated by those skilled in the injection molding art the difficulties and complexities of trying to create this two component combination as a single, unitary part.

Figure 13:
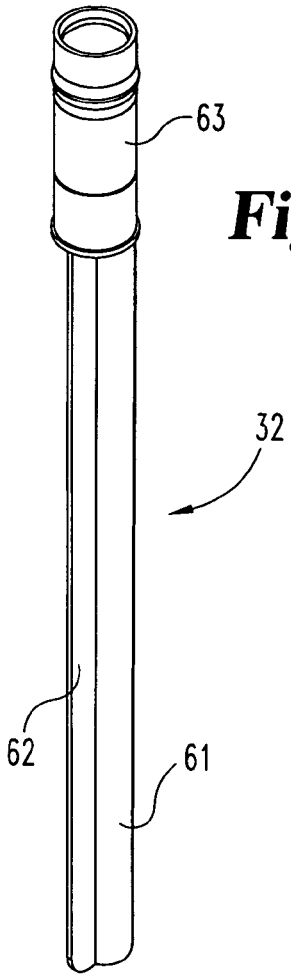
FIG. 13 is a perspective view of a dispensing spout comprising one component part of the FIG. 6 closure assembly.
Figure 14:
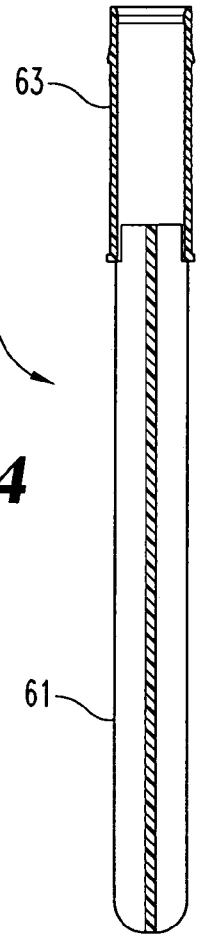
FIG. 14 is a side elevational view, in full section, of the FIG. 13 dispensing spout based upon the FIG. 4 orientation.
Figure 15:
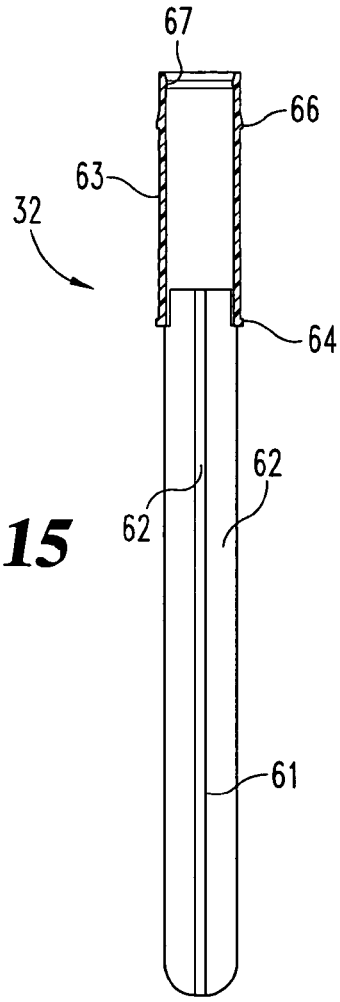
FIG. 15 is a front elevational view, in full section, of the FIG. 13 dispensing spout based upon the FIG. 5 orientation.

Referring now to FIGS. 13, 14, and 15, the details of dispensing spout 32 are illustrated. Dispensing spout 32 is a unitary, injection-molded component part that is preferably fabricated out of polypropylene. Dispensing spout 32 is a generally cylindrical tube that includes an extension member 61. Extension member 61 includes three equally-spaced, radiating spokes 62 that are joined to the inside surface of spout body 63. As will be described, the dispensing spout 32 is upwardly extendable in a telescoping manner relative to outlet 24, moving through outlet 24 and up through the inner fitment outlet 36. The extension member 61 is constructed and arranged to extend into the hollow interior of container 22. Container 22 is a flexible, blow-molded structure that has a construction in terms of the material and the material thickness to permit the container to collapse as product B is dispensed. The extension member 61 prevents container 22 from closing off the dispensing spout 32 as container 22 collapses. The use of extension member 62 enables the dispensing spout 32 to continue to provide an open dispensing path for product B at the desired flow rate and flow cross sectional area until all of the product B is dispensed from within container 22. This overall structure also ensures that the designed mix ratio will be maintained throughout the co-dispensing of products A and B, something that is not likely to occur if some of the flow of product B by way of spout 32 is partially blocked or partially closed off due to closing in of the interior of spout 32.

The dispensing spout 32 includes a radial lip 64 at the lower end of the spout body 63. As spout 32 is extended, the radial lip 64 is drawn upwardly toward shoulder 65 that defines the radial shelf between larger portion 45 and smaller portion 46. The sizes, shapes, and dimensions of radial lip 64 and shoulder 65 are such that the dispensing spout 32 cannot pull out of outlet 24 nor fitment outlet 36. The upper portion of the spout body 63 includes a radially outwardly extending annular rib 66 and axially spaced therefrom a radially inwardly extending annular rib 67. In the non-extended or fully nested or seated orientation of spout 32, rib 66 rests on the upper edge 68 of smaller portion 46. This abutment prevents the spout 32 from being pushed any farther into container 22 or any farther through inner fitment outlet 36. As such, this abutment sets the fully inserted depth of spout 32. When the spout 32 is extended, its maximum extension or extended length is controlled or set by the abutment of radial lip 64 with shoulder 65. The upper rib 66 is used for a connection with the threaded cap 33 so that, as the threaded cap is unscrewed from the adapter sleeve 31 and moves axially away from top panel 21*a*, the cap 33 pulls upwardly on spout 32, extending the spout for dispensing product B from within container 22.

Figure 16:
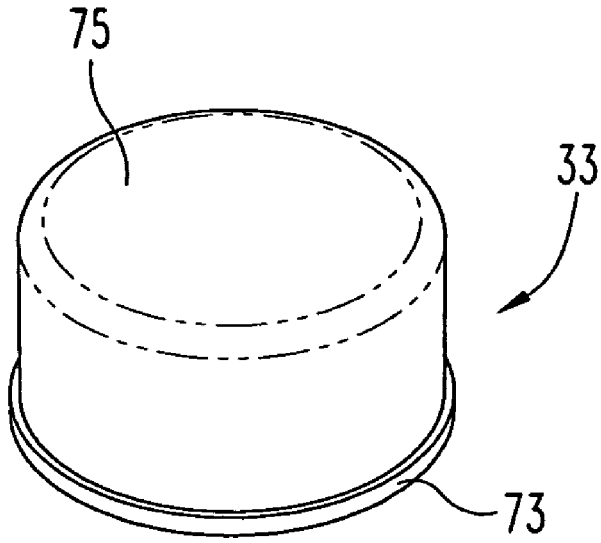
FIG. 16 is a perspective view of an outer threaded cap comprising one component part of the FIG. 6 closure assembly.
Figure 17:
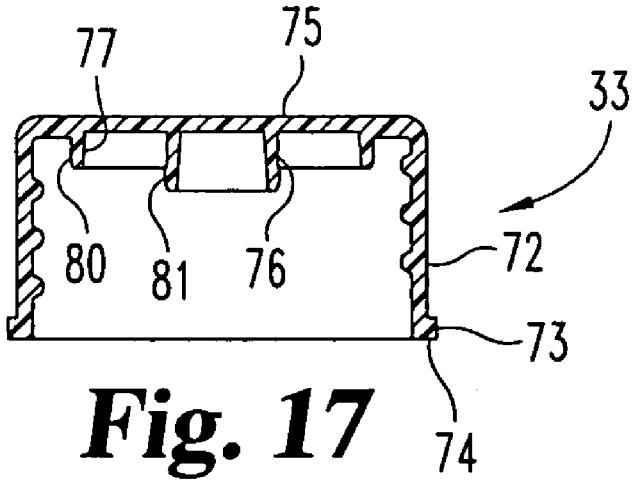
FIG. 17 is a side elevational view, in full section, of the FIG. 16 outer threaded cap based upon the FIG. 4 orientation.

Referring to FIGS. 16 and 17, the details of outer threaded cap 33 are illustrated. Threaded cap 33 is a unitary, injection-molded component part that is preferably fabricated out of polypropylene. Threaded cap 33 includes an internally-threaded, generally cylindrical sidewall 72, a radially-extending annular lip 73 adjacent the lower edge 74 of sidewall 72, a circular top panel 75, an inner tubular sleeve 76 that functions as a plug portion for closing spout 32, and intermediate annular wall 77.

The threaded construction of sidewall 72 is designed for tight and secure threaded engagement onto the sidewall 52 of adapter sleeve 31. As this threaded engagement occurs, annular lip 73 is axially moved toward the radial flange 53. At the same time, the upper edge of sidewall 52 is positioned in the annular clearance space defined by sidewall 72, intermediate annular wall 77, and top panel 75. Intermediate annular wall 77 includes a raised annular rib 80 that seals against the inside surface of sidewall 52. As the threaded cap 33 is threadedly advanced onto sidewall 52 of adapter sleeve 31, tubular sleeve 76 inserts into the upper open end of dispensing spout 32. The tubular sleeve 76 includes a raised annular rib 81 that snaps beneath annular rib 67 on the inside surface of the spout 32. The interfit of ribs 81 and 67 causes spout 32 to be extended as the threaded cap 33 is unscrewed from adapter sleeve 31. Once radial lip 64 abuts up against shoulder 65, that stops the movement of the extending spout 32. At the point of lip 64 to shoulder 65 abutment, the threaded cap 33 has been completely unthreaded from the adapter sleeve 31, allowing the cap 33 to be manually pulled free from the fully extended spout 32, thereby opening the end of the extended spout 32 for the dispensing of product B from within container 22.

In use, the fitment 30 is connected to the inner container 22 and pushed into top panel 21*a* with a secure and tight snap-fit. This subassembly occurs before panel 21*a* is seamed to the remainder of container 21 when the construction of container 22 does not permit it to be collapsed and inserted through outlet opening 23*a*. Preferably, the container 22 is filled with the desired volume of product B after the container 22 is installed into container 21. If a plastic bag or plastic pouch is used for container 22, the threaded neck outlet can be changed to a different securement technique. With this approach, the container 22 and fitment 30 comprise a first subassembly that is able to be snapped into container 21 as a subassembly. The adapter sleeve 31 can be preassembled to fitment 30 with either assembly sequence. The dispensing spout 32 first slides up into fitment outlet 36 and is then inserted into container 22.

Once products A and B are filled into their respective containers, the threaded cap is applied and the filled containers 21 and 22 are closed. All of the interfaces that might allow product leakage are tightly sealed and the two products A and B are separated and remain isolated from each other regardless of the movement or handling of the dispensing container 20.

When it is desired to dispense products A and B in the predetermined mixing ratio, threaded cap 33 is removed and this causes the extension of spout 32. Then, with cap 33 removed from the adapter sleeve 31 and from the end of spout 32, the flow paths for products A and B are open. Product A is dispensed from container 21 by way of annular clearance space 42. Product B is dispensed from container 22 by way of outlet 24, specifically spout 32. The extended nature of spout 32 ensures that there is no premixing of products A and B until they actually empty into the desired mixing container or receptacle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A dispensing container for two flowable products comprising:

a first container constructed and arranged for receiving a first flowable product, said first container including a first dispensing outlet and defining a hollow interior;

a second container constructed and arranged for receiving a second flowable product, said second container including a second dispensing outlet and being positioned in said hollow interior;

a fitment assembled into said first dispensing outlet and including means for connecting to said second dispensing outlet, said fitment including an inner outlet for dispensing said second flowable product and an outer outlet for dispensing said first flowable product;

an adapter sleeve assembled to said fitment;

a hollow dispensing spout inserted into said inner container and axially-extending through said inner outlet, said hollow dispensing spout defining an open outlet; and a threaded closing cap constructed and arranged to connect to said adapter sleeve, said threaded closing cap including a plug portion constructed and arranged for closing off said open outlet.

2. The dispensing container of claim 1 wherein said inner outlet and said outer outlet are substantially concentric with each other.

3. The dispensing container of claim 2 wherein said dispensing spout is constructed and arranged to be axially movable relative to said inner outlet.

4. The dispensing container of claim 3 wherein said dispensing spout includes an extension that is constructed and arranged to support said dispensing spout against collapse due to collapse of said second container.

5. The dispensing container of claim 4 wherein said inner outlet includes an internally-threaded portion that is constructed and arranged to connect to said second container.

6. The dispensing container of claim 5 wherein said fitment includes a vent tube that is constructed and arranged to extend into said first container.

7. The dispensing container of claim 6 wherein said plug portion connects to said open outlet for extending said dispensing spout with removal of said threaded closing cap.

8. The dispensing container of claim 7 wherein said inner outlet is constructed and arranged with a second flow area for dispensing said second product and said outer outlet is constructed and arranged with a first flow area for dispensing said first product.

9. The dispensing container of claim 8 wherein said first flow area is larger than said second flow area.

10. The dispensing container of claim 8 wherein said first flow area is approximately twice the size of said second flow area.

11. The dispensing container of claim 1 wherein said dispensing spout is constructed and arranged to be axially movable relative to said inner outlet.

12. The dispensing container of claim 1 wherein said dispensing spout includes an extension that is constructed and arranged to support said dispensing spout against collapse due to collapse of said second container.

13. The dispensing container of claim 1 wherein said inner outlet includes an internally-threaded portion that is constructed and arranged to connect to said second container.

14. The dispensing container of claim 1 wherein said fitment includes a vent tube that is constructed and arranged to extend into said first container.

15. The dispensing container of claim 1 wherein said plug portion connects to said open outlet for extending said dispensing spout with removal of said threaded closing cap.

16. The dispensing container of claim 1 wherein said inner outlet is constructed and arranged with a second flow area for dispensing said second product and said outer outlet is constructed and arranged with a first flow area for dispensing said first product.

17. The dispensing container of claim 16 wherein said first flow area is larger than said second flow area.

18. The dispensing container of claim 16 wherein said first flow area is approximately twice the size of said second flow area.

19. A dispensing container for two flowable products comprising:

a first container constructed and arranged for receiving a first flowable product, said first container including a first dispensing outlet and including a hollow interior;

a second container constructed and arranged for receiving a second flowable product, said second container including a second dispensing outlet and being positioned in said hollow interior;

a fitment assembled into said first dispensing outlet and including means for connecting to said second dispensing outlet, said fitment defining an inner outlet for dispensing said second flowable product and an outer outlet for dispensing said first flowable product;

an adapter sleeve assembled to said fitment; and a threaded closing cap constructed and arranged to connect to said adapter sleeve, said threaded closing cap including a plug portion constructed and arranged for closing off said inner outlet.

20. The dispensing container of claim 19 wherein said inner outlet and said outer outlet are substantially concentric with each other.

21. The dispensing container of claim 20 wherein said inner outlet includes an internally-threaded portion that is constructed and arranged to connect to said second container.

22. The dispensing container of claim 21 wherein said fitment includes a vent tube that is constructed and arranged to extend into said first container.

23. The dispensing container of claim 22 wherein said inner outlet is constructed and arranged with a second flow area for dispensing said second product and said outer outlet is constructed and arranged with a first flow area for dispensing said first product.

24. The dispensing container of claim 23 wherein said first flow area is larger than said second flow area.

25. The dispensing container of claim 23 wherein said first flow area is approximately twice the size of said second flow area.

26. The dispensing container of claim 19 wherein said inner outlet includes an internally-threaded portion that is constructed and arranged to connect to said second container.

27. The dispensing container of claim 19 wherein said fitment includes a vent tube that is constructed and arranged to extend into said first container.

28. The dispensing container of claim 19 wherein said inner outlet is constructed and arranged with a second flow area for dispensing said second product and said outer outlet is constructed and arranged with a first flow area for dispensing said first product.

29. The dispensing container of claim 28 wherein said first flow area is larger than said second flow area.

30. The dispensing container of claim 28 wherein said first flow area is approximately twice the size of said second flow area.

* * * * *